United States Patent [19]

Plant

[11] 4,422,892

[45] Dec. 27, 1983

[54] METHOD OF MAKING A BONDED CORRUGATED NONWOVEN FABRIC AND PRODUCT MADE THEREBY

[75] Inventor: Derek Plant, Runnemede, N.J.

[73] Assignee: Scott Paper Company, Philadelphia, Pa.

[21] Appl. No.: 260,507

[22] Filed: May 4, 1981

[51] Int. Cl.[3] ..... B32B 3/30; B32B 3/02

[52] U.S. Cl. ..... 156/209; 156/308.2; 264/282; 428/152; 428/156; 428/296

[58] Field of Search ..... 428/182, 152, 181, 156, 428/198, 167, 296; 156/308.2, 209; 264/282, 283, 286; 162/111

[56] References Cited

U.S. PATENT DOCUMENTS

| | | | |
|---|---|---|---|
| 3,059,313 | 10/1962 | Harmon | 428/198 |
| 3,687,754 | 8/1972 | Stumpf | 156/72 |
| 3,949,128 | 4/1976 | Ostermeier | 428/152 |
| 4,090,385 | 5/1978 | Packard | 72/191 |
| 4,315,965 | 2/1982 | Mason et al. | 428/198 |

*Primary Examiner*—Paul J. Thibodeau
*Attorney, Agent, or Firm*—Joseph H. Yamaoka

[57] ABSTRACT

A nonwoven fabric is made by first forming a web (12) consisting predominately of thermoplastic fibers, then pattern embossing the web at an elevated temperature to form autogenous thermal bonds extending through the web, then creping the bonded web by pressing the bonded web against a driven, grooved roll (30) which feeds the web against a retarding member (32). The temperature of the web during the creping step is controlled so that some of the thermoplastic fibers are softened which assists the formation and retention in the web of both the crepe and noticeable ridges 50 of predominately unbonded fibers. This heating of the web (12) also results in some bonding of fibers in the grooves (52) of the creped web (12) which gives the web (12) a striped appearance. In the creped web, when the autogenous bonds are lineal and generally extend in the cross direction of the web, the creped web can take on a seersucker or corduroy-like appearance depending upon the amount of compaction during the creping step.

11 Claims, 6 Drawing Figures

METHOD OF MAKING A BONDED CORRUGATED NONWOVEN FABRIC AND PRODUCT MADE THEREBY

TECHNICAL FIELD

This invention relates generally to the field of nonwoven fabrics, and in particular to a bonded corrugated, nonwoven fabric having lofty ridges containing predominately unbonded fibers separated by grooves having a higher fiber density which gives the grooves a striped appearance, and to the method of making said fabric. The method is particularly suited for making a fabric having a seersucker or corduroy appearance.

BACKGROUND ART

Nonwoven fabrics have become quite popular for many different uses wherein textile-like properties, such as softness, drapability, strength and abrasion resistance are desired. One type of elastic nonwoven fabric is disclosed in U.S. Pat. No. 3,687,754 issued to Robert J. Stumpf on Aug. 19, 1971. Stumpf discloses a method of making a fabric by first forming a base web of thermoplastic fibers and then applying adhesive in an open pattern to one side of the web. The adhesive is allowed to set and cure. The web is then blade creped at an elevated temperature. The elevated temperature is sufficient to cause the open pattern of adhesive in which the fibers are embedded to be reactivated so that, during the creping step, the adhesive pattern is partially consolidated into a backing layer, while portions of the fibers across the open spaces of the adhesive pattern loop outwardly from the backing layer. The elevated temperature is controlled to minimize the bonding in the partially consolidated adhesive backing while at the same time allowing the thermoplastic fibers to be heat set to retain the crepe.

The type of creping, described in the Stumpf patent, wherein the web is adhered to a creping surface and removed therefrom by means of a doctor blade is generally known in the art as blade creping. The type of creping apparatus utilized in this invention, wherein the creping is accomplished through a combination of retarding and compressing the web during its travel on and removal from a roll, is known in the art as microcreping. U.S. Pat. No. 4,090,385, issued to Thomas D. Packard, on May 23, 1978, discloses a microcreping apparatus in which the roll is grooved. Although the creping apparatus described by Packard includes a grooved roll, it is contemplated by Packard that the grooves do not substantially contribute to the final shape of the creped web. Thus, at column 1, lines 64–68, Packard states that it is an object of his invention to provide a creping apparatus that has a minimum of undesirable effects such as longitudinal corrugation or streaking of the material caused by the retarder member. Packard, at column 2, lines 42–48, also states that the width of the grooves are quite small so that there is less tendency for the material to indent into and be corrugated or marked by the narrow grooves. And finally, at column 5, lines 46–50, Packard states that the grooves of the roll surface and the slots of the retarder member do not, in most instances, longitudinally corrugate or streak the material, or otherwise impair the uniformity of treatment of the material by the creping apparatus.

U.S. Pat. No. 3,949,128, issued to Kurt W. Ostermeier on Apr. 6, 1976, discloses a method of making an elastic nonwoven fabric by first forming a web of continuous filament thermoplastic fibers, which is stablized by a pattern of spot bonds extending through the formed webs. The stabilized web is then heated, drawn and heat set. The drawn web is then microcreped, that is, the web is forced against the surface of a smooth, heated drum which transports the web between a flexible blade and a retarding member to cause foreshortening or creping of the web. The microcreped web is then passed through an oven in order to heat set the filaments in their microcreped condition. Because the microcreping was effected on a smooth surface roll, a cross section of the microcreped fabric taken in the cross machine direction of the web, will have a relatively uniform thickness.

DISCLOSURE OF INVENTION

In accordance with this invention, a nonwoven fabric is made by first forming a web consisting predominately of thermoplastic fibers, then pattern embossing the web at an elevated temperature to form autogenous thermal bonds extending through the web, then creping the bonded web by pressing the bonded web against a driven, grooved roll which feeds the web against a retarding member. The temperature of the web during the creping step is controlled so that some of the thermoplastic fibers are softened which assists the formation and retention in the web of both the crepe and noticeable ridges of predominately unbonded fibers. A higher density of fibers in the grooved portion of the creped web gives the web a striped appearance. It is important to control the ratio of the rate of feeding the web onto the retarding member to the rate of removal of the web from the retarding member (i.e. the creping compaction) since it has been found that at low compaction levels, the ridges and stripes are barely perceptible.

In one preferred embodiment, the thermal bonds that extend through the web are lineal segments which extend continuously across the cross direction of the web.

It is also preferred that the autogenous bonds formed in the web prior to creping are predominately melt bonds in one surface of the web and are predominately stick bonds in the other surface of the web.

The term "melt bonds" or "molten bond", as used in this application, refers to a bond established by melting fibers and is characterized by an appearance wherein the identity of individual fibers in the bond zone is substantially obliterated; taking on a film-like appearance. The term "stick bond" as used in this application, refers to a bond established by heating the fibers to a tacky state in which they are capable of sticking to each other, but wherein the physical fiber form or appearance is still retained; albeit generally in a somewhat flattened state.

The nonwoven web of the invention is a corrugated, nonwoven, creped web made with predominately thermoplastic fibers. The creped web has lineal bond lines extending generally in the cross direction of the web and has ridges, consisting predominately of unbonded fibers extending in the machine direction of the web.

BRIEF DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

BEST MODE FOR CARRYING OUT THE INVENTION

Figure 1:
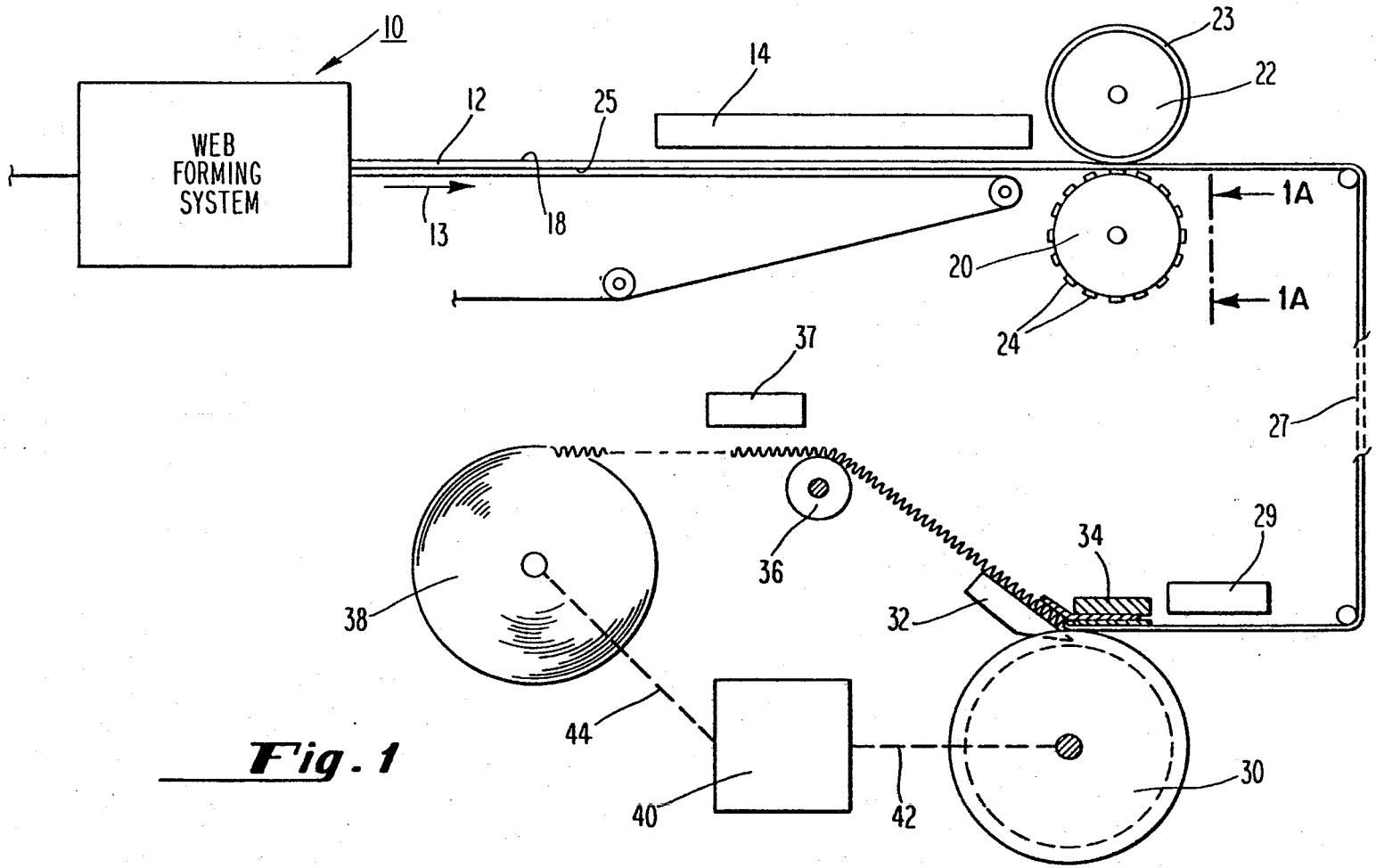
FIG. 1 is a schematic elevation view of an arrangement for carrying out the preferred method of this invention.

FIG. 1 is a schematic representation of equipment for making the corrugated, nonwoven fabric of this invention. A web-forming system 10, such as a carding system, is employed to initially form a fibrous web 12 of thermoplastic fibers. Thermoplastic fibers include, among others, nylon fibers, acrylic fibers, polyester fibers and olefins such as polypropylene. It is believed that the webs of this invention can be formed from a fiber blend wherein some of the fibers are not thermoplastic. However, it is believed that this invention requires that a preponderance, by weight, of the fibers be thermoplastic textile-length fibers greater than 0.0064 meters (¼ inch) in length, and preferably, greater than 0.0254 meters (1 inch) in length. The preferred fibers employed to form the web 12 are 100% polypropylene, 3 denier, having a length of 0.0508 meters (2 inches) sold under the trademark MARVESS by Philips Fibers Corporation, a subsidiary of Philips Petroleum Company.

The web 12, as initially formed, is quite weak, since the fibers are held together only by the entanglement that naturally occurs when the fibers are deposited on a forming surface, and by the cohesive or frictional forces between contacting fibers. When the web is formed by a carding or similar operation, the fibers are aligned predominately in the machine direction of web formation, as indicated by arrow 13, and is particularly weak in the cross machine direction.

After the web is formed it is directed through a preheating station which, in the illustrated embodiment, comprises a bank of infrared panels 14 located adjacent to the upper surface 18 of the web 12. The preheated web 12 is then directed immediately into the pressure nip of a bonding station provided by opposed rolls 20 and 22. The roll 20 which contacts the lower surface 25 of the web 12 is a metal embossing roll, and is heated to a temperature greater than the melting point of the polypropylene fibers. The back-up rolls 22, which contacts the upper surface 18 of the preheated web 12, preferably has a resilient surface provided by a one inch thick polyamide (nylon) cover 23 having a 90 durometer-Shore A. Because the back up roll 22 has a resilient surface, the nip width is about 0.0127 meters (0.5 inches), which provides a more uniform pressure distribution in the nip than would otherwise be the case if the back up roll 22 were nonresilient. When the temperature of the infra red panels 14, as well as the temperature of the heated embossing roll 20 and the back up roll 22 are coordinated with the fiber characteristics, the basis weight of the web 12, the line speed and the bonding pressure, a web can be formed having autogenous bonds extending from the surface 25 to the surface 18 of the web 12. Furthermore, the process can be controlled so that the autogenous bonds in the surface 25 are predominately (preferably over 80%) melt bonds and the autogenous bonds in the surface 18 of the web 12 are well over 90% stick bonds which tie down the surface fibers without adversely affecting the tactile properties of that surface. In fact, as described in U.S. Pat. No. 4,315,965 issued Feb. 16, 1982 to—Mason, et al, which is assigned to the assignee of this application, and which is incorporated herein by reference, it is possible to achieve an improved depth of penetration of melt bonds while maintaining the surface 18 of the web 12 substantially devoid of melt bonds.

Figure 1A:
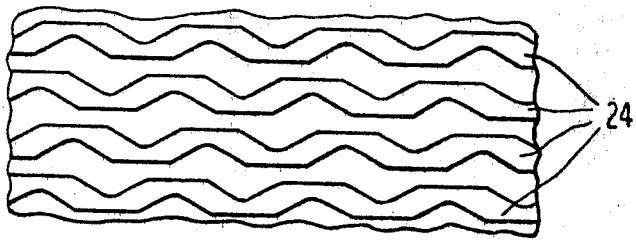
FIG. 1*a* is a fragmentary elevation view of the embossing roll illustrating a preferred arrangement of the land areas.

FIG. 1*a* shows a preferred pattern of land areas 24 extending transversely across the embossing roll 20 to form transverse molten bonds for enhancing the cross machine direction strength of the bonded web. The width of the land areas 24 varies between 0.0203 cm (0.008 inches) and 0.0635 cm (0.025 inches), has an average machine direction repeat length of about 0.00195 meters (0.077 inches), and occupies approximately 22% of the surface area of the embossing roll 20.

The now autogenously bonded web 12 is directed into a creping apparatus comprising a heated, grooved roll 30, retarding member 32 and pressing means 34. The web is depicted by dashed lines 27 between embossing roll 20 and creping roll 30 to indicate that the process for making the web of this invention can be continuous as shown in FIG. 1 or the autogenous bonded web can be rolled into parent rolls with the processing after dashed lines 27 being performed off line. The creped web is then wound onto a parent roll 38. Although the creping roll 20 is described as being heated, it is believed that a similar result can be achieved by using an unheated grooved roll 30 but preheating the web 12 by means such as infrared heater 29.

Figure 2:
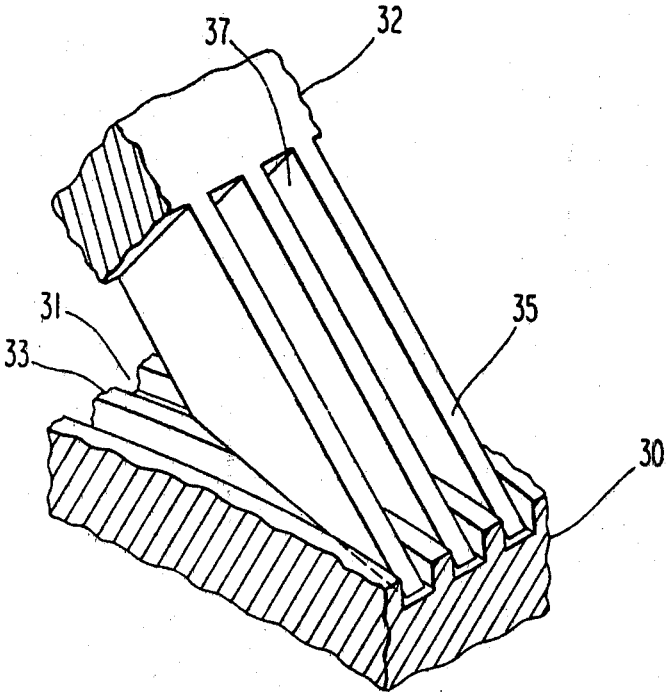
FIG. 2 is an enlarged partial isometric view of a portion of the grooved roll and retarding member depicted in FIG. 1.

FIG. 2 illustrates in detail the cooperation of retarding member 32 with grooved roll 30. As shown in FIG. 2, the surface of roll 30 consists of a plurality of alternating land areas 33 and grooves 31. That portion of the retarding member 32 that cooperates with the grooved roll 30 comprises a plurality of teeth 35 which project into the grooves 31 of roll 30. Between each pair of teeth is a slot 37 through which the land areas 33 of grooved roll 30 can pass. A more detailed description of the creping apparatus can be found in U.S. Pat. No. 4,090,385 issued to Thomas D. Packard on May 23, 1978.

Referring back to FIG. 1, it is normal to control the amount of crepe or foreshortening of the web 12 by controlling the speed at which the creped web is removed from the creping apparatus as compared to the speed of the web coming into the creping apparatus. This is represented schematically in FIG. 1 by means of a variable speed control device 40, which, as indicated by dashed line 42 can control the speed of the grooved roll 30 and which, by means of dashed line 44 can control the speed of the web as it is being rolled into parent roll 38. It may be desirable to further heat set the crepe into the web and for that purpose there is provided web heating means 37 which could, for example, be an infrared heater.

It has been found that when a thermally bonded web having a basis weight of about 30 grams per square meter is treated with a microcreping apparatus employing a cold grooved roll 30, the web is not substantially affected by the grooves in the roll 30, that is, the grooves do not cause the creped web to have noticeable ridges of unbonded fibers corresponding to the grooves 31 in the roll 30. The same base web was microcreped with a grooved roll 30 heated to 99° C. at nominal compactions of 2, 5, and 10%. These lightly compacted webs also were not substantially affected by the grooves 31 in the roll 30 and the finished product did not have noticeable ridges of unbonded fibers corresponding to grooves 31 in the roll 30. These lightly compacted webs made on heated, grooved roll 30 also were not substantially affected by the land areas 33 of roll 30, that is, any densification of fibers which pass over the land areas 33 is barely perceptible to the naked eye. Data obtained from some of these samples are provided in Table 1 below.

The base web was then microcreped on a heated, grooved roll 30 at nominal compactions of 30% and 40%. At these higher compaction levels, there is a very definite ridge of lofted, primarily unbonded fibers corresponding to the grooves 31 in the roll 30. Also at these higher compaction levels the higher density of fibers in the grooved portions of the creped web gives the grooves in the web a highly perceptible striped appearance. These ridges of unbonded fibers and striped grooves are believed to first occur, at a compaction level between about 15% and 30%. At compaction levels of 30% and 40% there is also a considerable area of substantially unbonded fiber between successive lineal bond segments and the creped web has a definite seersucker appearance. As the compaction level is increased, the visible area of unbonded fibers between successive lineal bond segments is reduced. At high levels of compaction, for example 75%, successive lineal bond segments are very close together and the resulting web has a distinctly corduroy-like appearance. Data obtained from measurements on some of these samples are also provided in Table 1 below.

Figure 3:
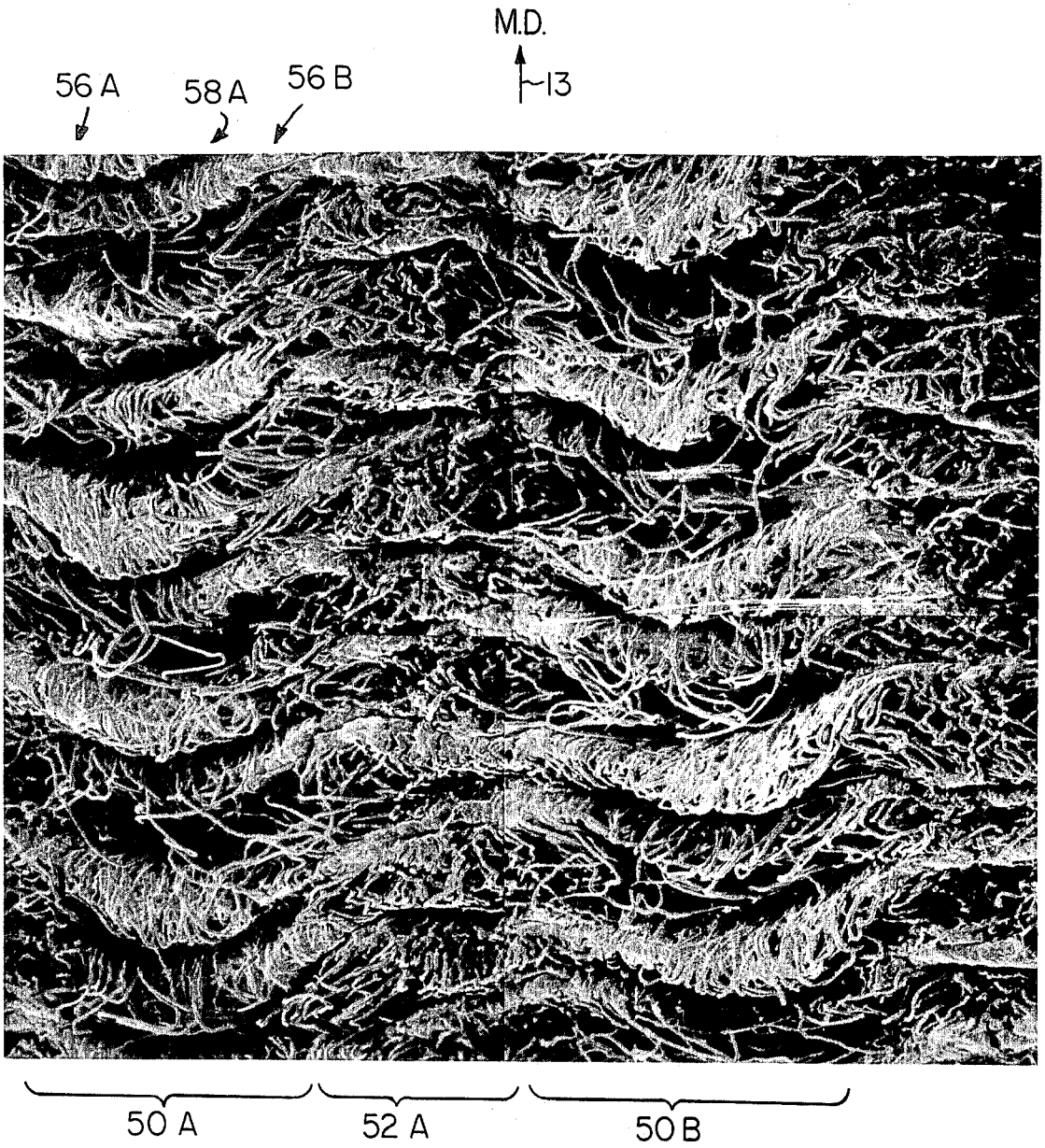
FIG. 3 is a scanning electron microscope photograph, at a magnification of 25, showing one surface of the web made in accordance with this invention.
Figure 4:
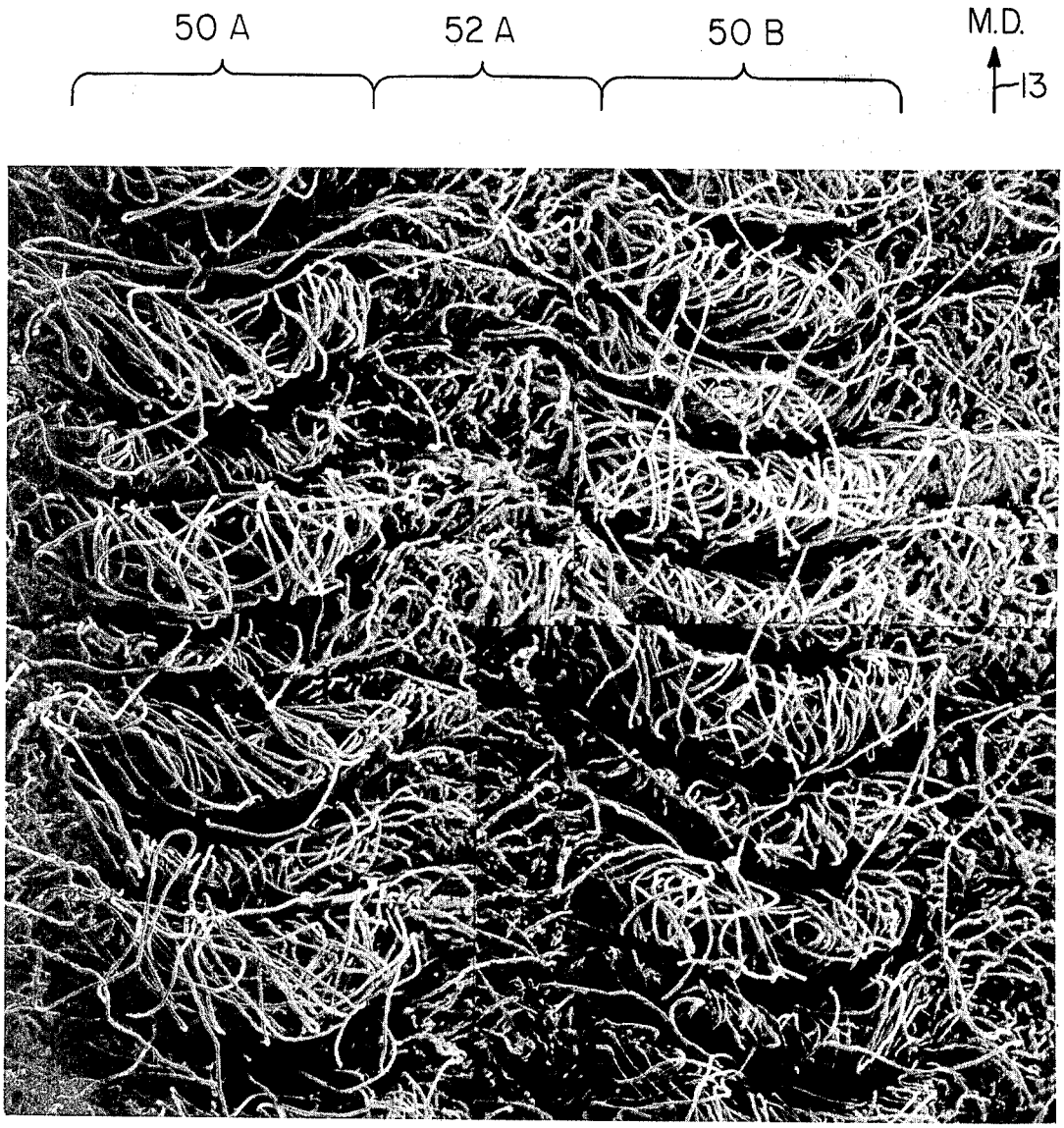
FIG. 4 is a scanning electron microscope photograph, at a magnification of 25, showing the surface of the web opposite that shown in FIG. 3.
Figure 5:
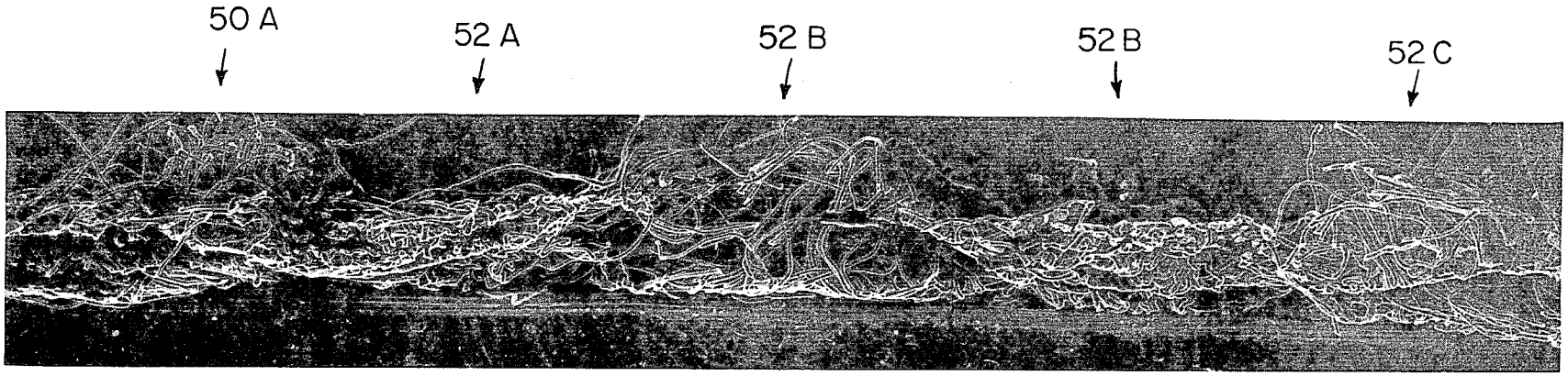
FIG. 5 is a scanning electron microscope photograph, at a magnification of 25, showing a cross section of the web looking in the machine direction of the web.

FIGS. 3, 4 and 5 are scanning electron microscope photographs, at a magnification of 25 times, of a creped web 12 that has been compacted by about 60%. FIG. 3 depicts the surface 25, FIG. 4 depicts the surface 18 and FIG. 5 is a cross section looking in the machine direction of the creped web 12.

In the finished web, the surface 18 has very pronounced ridges 50A, 50B and 50C caused by fibers that have been forced into the grooves 31. As best seen in FIG. 5, these ridges 50A, 50B and 50C consist primarily of unbonded fibers. Although some originally bonded fibers may be forced into the grooves 31 of the roll 30, the unbonded fibers generally are forced deeper into the groove 31 to form the peaks of the ridges 50.

Refer now to FIG. 4, which is a view of the surface 18 in which the ridges are formed. The surface includes: two ridges 50A and 50B which extend in the machine direction which is indicated by the arrow 13. From FIG. 4, it can be seen that the ridges 50 are not continuous in the machine direction but consist of a series of pleats formed by primarily unbonded fibers in the area between two successive bond lines that extend generally in the cross machine direction. Between the lofted ridges 50 are grooves 52, such as 52A, which extend in the machine direction of the web. These grooves 52 are formed as the web is compressed between the pressing means 34 and the land portions 33 of the grooved roll 30. Most of the originally unbonded fibers within the lofted ridges 50 do not appear to have been affected by the heated roll 30 in that the fibers while they have become pleated, have not otherwise become distorted and do not appear to have formed bonds within the ridges 50. This is in contrast to the grooved region 52 wherein most of the fibers including those which were originally unbonded prior to creping have been softened, deformed, and crinkled during the creping operation, the deformation being set upon cooling of the web. It is also to be noted that the fiber density in the grooved regions 52 is greater than the fiber density of the ridges 50 which gives the finished web a very pronounced striped appearance.

FIG. 3 is a picture of a portion of surface 25 of the web after it has been creped. The machine direction of the web is indicated by the arrow 13. The widths 50A and 50B at the bottom of FIG. 3 indicate the approximate locations of the ridged portions 50 of the creped web and the width 52A corresponds to approximately a grooved portion 52 of the creped web. The surface of the web corresponding to a ridge 50A consists of a series of bonded lines such as 56A and 56B (both bonded lines only partially appearing in the figure) separated by an area 58A consisting mostly of pleated unbonded fibers (the unbonded fibers not being visible from this surface). The spacing between bonded areas 56A and 56B is determined by the amount of compaction of the web. If the web is highly compacted, with the particular bonding pattern employed, about 70% compacted, the bonding areas 56A will be very nearly adjacent to the bonded area 56B and the unbonded area 58A will have a very short length in the machine section. FIG. 3 also shows that the melt bonds that were originally in the surface 25 of the web remain in that surface after creping. This is also illustrated in FIG. 5 where the portions designated 54A, 54B and 54C show melt bonds within the surface 25 of the web but as soon as you get into the web, particularly in the lofted stripe areas 50A, 50B and 50C, the fibers appear for the most part to be unbonded.

At the compaction levels where successive bond lines are compacted to be very close together, for example with the disclosed pattern about 75% compaction, the web has a corduroy like appearance. When the compaction levels are in the range of 30 to 50% so that there is relatively large distance between successive bond lines in the creped web, the finished fabric has a seersucker appearance.

A number of example webs were made and tested. Relevant data is summarized in Tables I and II.

TABLE I

| Sample | 1 | 2 | 3 | 4 | 5 | 6 | 7 |
|---|---|---|---|---|---|---|---|
| Basis Weight ($g/m^2$) | 31.36 | 35.09 | 33.40 | 34.58 | 41.70 | 51.87 | 109.51 |
| Compaction (%) | 5.34 | 14.51 | 9.09 | 13.24 | 29.06 | 43.16 | 92.61 |
| Bulk (mm) | 0.356 | 0.483 | 0.368 | 0.445 | 0.66 | 0.81 | — |
| CD Wet Tensile (kg/m) | 11.65 | 13.70 | 13.31 | 11.46 | 16.53 | 22.48 | — |
| CD Wet TEA ($kg\text{-}m/m^2$) | 3.46 | 3.98 | 4.41 | 3.50 | 4.29 | 7.36 | — |
| CD Wet Stretch (%) | 51 | 46 | 60 | 53 | 45 | 48 | — |
| MD Wet Tensile (kg/m) | 48.62 | 41.38 | 84.05 | 75.27 | 92.20 | 79.53 | 65.33 |
| MD Wet TEA ($kg\text{-}m/m^2$) | 12.91 | 3.50 | 7.09 | 6.65 | 21.57 | 39.09 | 63.15 |
| MD Wet Stretch | 32 | 19 | 16 | 19 | 53 | 107 | 325 |

TABLE I-continued

| Sample | 1 | 2 | 3 | 4 | 5 | 6 | 7 |
|---|---|---|---|---|---|---|---|
| (%) | | | | | | | |

The base web for samples 1 through 7 of Table I is a web of 100% polypropylene fibers, 3 denier having a length of 0.0508 meters (2 inches). The web was autogenously bonded in a pattern similar to that depicted in FIG. 1A. The average spacing between bond lines is 0.00195 meters and about 22 percent of the web surface is covered by bond lines. The formation of the thermal bonding has been controlled so that the bonds in one surface are predominately (over 80%) melt-bonds while the bonds in the other surface contain relatively few (less than 10%) melt bonds or consist predominately of stick bonds.

The basis weight of the base web is about 30 grams per square meter.

Samples 1 and 2 are base webs that have been microcreped from an unheated grooved roll 30. Samples 3, 4, 5, 6 and 7 are base webs that have been microcreped from a grooved roll 30 heated to 99° C. The creped webs were all run with the surface of the web that contains predominately stick bonds against the grooved roll 30.

It was noted that samples 5, 6 and 7 exhibited noticeable ridges formed primarily by unbonded fibers which were forced into the grooves 31 of the roll 30 during creping and very noticeable stripes caused by some compression and bonding of fibers that were constrained between the pressing means 34 and the land area 33 of the grooved roll 30. Samples 1 through 4 did not exhibit either the pronounced ridging of primarily unbonded fibers or stripes due to the heating and compression of fibers.

Samples 5, 6 and 7 had a significant increase in bulk, which in conjunction with the ridges of unbonded fiber and stripes of compressed fibers caused the web to have a pleasing textile appearance. Samples 5 and 6, which have an actual compaction of 29% and 43%, have a considerable area of unbonded fibers between adjacent bond lines, which gives the creped web a seersucker appearance. In sample 7 which has an actual compaction of 73%, adjacent bond lines are very close together and the creped web has a corduroy like appearance.

TABLE II

| Sample | 8 | 9 | 10 | 11 | 12 | 13 |
|---|---|---|---|---|---|---|
| Basis Weight ($g/m^2$) | 29.33 | 61.03 | 49.16 | 28.50 | 60.69 | 60.35 |
| Compaction (%) | 0 | 48.06 | 41.34 | 0 | 53.07 | 52.81 |
| Bulk (millimeters) | 0.223 | 0.965 | 1.07 | 0.254 | 1.09 | 1.143 |
| CD Wet Tensile (kg/m) | 10.59 | 33.70 | 28.39 | 11.10 | 28.03 | 26.26 |
| CD Wet TEA ($kg\text{-}m/m^2$) | 3.54 | 9.13 | 7.52 | 3.98 | 9.09 | 7.40 |
| CD Wet Stretch (%) | 48 | 40 | 41 | 56 | 56 | 52 |
| MD Wet Tensile (kg/m) | 92.52 | 92.40 | 76.14 | 89.96 | 64.76 | 51.34 |
| MD Wet TEA ($kg\text{-}m/m^2$) | 7.17 | 5.79 | 11.46 | 7.48 | 8.07 | 12.32 |
| MD Wet Stretch (%) | 12 | 130 | 132 | 14 | 154 | 144 |

Sample 8 is basically the same base web that was used to make samples 1 through 7 of Table I.

Sample 9 is the web of sample 8 after it has been microcreped from a grooved roll heated to 99° C. The web was fed onto the grooved roll so that the surface 18 that contained predominately stick bonds was adjacent to the grooved roll 30 surface. The web was removed from the creping apparatus at a speed of about 15.24 meters per minute.

Sample 10 is the web of sample 8, microcreped under the same conditions as sample 9 except that the surface 25 that contained predominately melt bonds was adjacent to the grooved roll surface.

Sample 11 is a web made by a process similar to that used to make sample 8 except that the bonding pattern is a diamond pattern formed by substantially parallel lines spaced about 0.00363 meters apart that intersect at an angle of 60 degrees. The diamonds are oriented so that the long dimension of the diamond is aligned with the machine direction of the web. The bonding pattern covers about 25% of the surface area of the uncreped web.

Sample 12 is the web of sample 11 microcreped under the same conditions as sample 9.

Sample 13 is the web of sample 11 microcreped under the same conditions as sample 10.

The bulk data was measured on an Ames bulk tester at a loading of 0.16 kilograms.

Tensile energy absorption (TEA) is the area under the stress/strain curve at web failure, and represents the energy absorbed by the product as it is stretched to failure. The TEA and strength levels reported in this application can be determined on a Thwing Albert Electronic QC Tensile Tester, "Intelect 500", with a 4.54 kg (160 ounces) load cell, and being set at 99% sensitivity. The test is carried out by clamping a 0.0254 m (1 inch)×0.1778 m (7 inch) retangular test sample in opposed jaws of the tensile tester with the jaw span being 0.127 m (5 inches). The jaws are then separated at a crosshead speed of 0.127 m (5 inches) per minute until the sample fails. The digital integrator of the tensile tester directly computes and displays tensile strength (grams/inch), TEA (inch-grams/$inch^2$) and stretch (%) at failure. Wet TEA, strength and stretch values are obtained by immersing the sample in water prior to testing.

The creping apparatus was operated to provide a nominal compaction. It is believed that a more accurate value of the percent compaction of the creped web is obtained by comparing the basis weight of the creped web to the basis weight of the uncreped web. The calculated compaction is shown in Tables I and II.

The data indicates that there is a large increase in machine direction stretch and a slight degradation of the cross direction stretch so that the overall stretch characteristic of the higher compacted web is greatly improved over the base web.

In comparing sample 9 with sample 10, there is little difference in either the appearance or feel of the creped webs. This indicates that there is not much difference between creping the web with the surface 25 containing predominately melt bonds next to the surface of roll 30 and creping the web with the surface 18 containing predominately stick bonds next to the surface of the roll 30. A similar observation applies to the comparison of sample 12 with sample 13. Also, in comparing sample 9 with sample 10 and sample 12 with sample 13, it is noted that the bond lines of the uncreped web generally tend to remain between the compressing member 34 and the land portions 33 of roll 30. However, in samples 12 and 13 wherein the bonded lineal segments are more nearly aligned with the grooves, there is a tendency for the bonded lines to be pulled into the groove, but the unbonded fibers between the bonded lines are pulled more deeply into the grooves to form a pleat of unbonded fibers which extends into the peak of the ridges 50. It is preferred that the bonding pattern of the base web prior to creping extend across the cross direction of the web and that the bonding lines be substantially continuous. By "substantially continuous" is meant that the bonds are either completely continuous, or have limited discontinuities in them. Although the bonding pattern is referred to as being lineal, it does not have to be made up of straight lines but as illustrated in FIG. 1A can be curvilinear. It is preferred that the lineal segment of the bonding lines in the uncreped web span a greater distance in the cross direction of the web than in the machine direction of the web. It is also preferred that the successive bonding lines in the machine direction of the uncreped web do not intersect for example, as depicted in FIG. 1A. Thus, the bonding pattern used for samples 9 and 10 are preferred to the bonding pattern of samples 12 and 13 in which the lineal bond segments span a greater distance in the machine direction than in the cross direction and wherein successive lineal segments, in the machine direction intersect to form a diamond bonding pattern. Samples 9 and 10 feel considerably softer than samples 12 and 13.

Data was also obtained on a base web of 1.8 denier polypropylene fibers bonded with the diamond pattern used to bond samples 11, 12 and 13. The base web had a basis weight of 23.4 grams per square meter. The web was microcreped under the same conditions as samples 12 and 13 with comparable bulk and strength characteristics when compared to samples 12 and 13 but appeared considerably softer than samples 12 and 13.

While the present invention has been described with respect to a specific embodiment thereof, it will be obvious to those skilled in the art that various changes and modifications may be made without departing from the invention in its broader aspects.

What is claimed as new and desired to be secured by Letters Patent of the United States is:

1. A method of making a corrugated, nonwoven fabric comprising the steps of:

(a) forming a web predominately of thermoplastic fibers;

(b) pattern embossing the web at an elevated temperature so as to form autogenous bonds extending through the web and in said pattern;

(c) creping the bonded web at an elevated temperature by pressing the web against a driven roll which feeds the web against a retarding member, said roll having grooves extending perpendicular to the axis of the roll;

(d) controlling the removal of the web from the retarding member so that the web is foreshortened in the driven direction by at least 40 percent and so that said grooves cause noticeable ridges to be formed in the web, said ridges extending in the driven direction of the web; and (e) controlling the temperature of the web during the creping step so that some of the thermoplastic fibers are softened and the fabric tends to retain the crepe and ridges when the web cools.

2. A method of making a corrugated, nonwoven fabric comprising the steps of:

(a) forming a web predominately of thermoplastic fibers;

(b) pattern embossing the web at an elevated temperature to form lineal autogenous bonds extending through the web and generally spanning a greater distance in a cross direction than in a machine direction of the web;

(c) creping the bonded web at an elevated temperature by pressing the web against a driven roll which feeds the web in said machine direction against a retarding member, said roll having grooves extending perpendicular to the axis of the roll;

(d) controlling the removal of the web from the retarding member so that the web is foreshortened in the machine direction by at least 40 percent and so that said grooves cause noticeable ridges of predominately unbonded fibers to be formed in the web, said ridges extending in the machine direction of the web; and (e) controlling the temperature of the web during the creping step so that some of the thermoplastic fibers are softened and the fabric tends to retain the crepe and ridges when the web cools.

3. A nonwoven web made according to the method of claims 1 or 2.

4. A method as recited in claim 3 characterized in that the autogenous bonds in the web, before creping, are predominately melt bonds extending from one surface of the web and are over 90% stick bonds in the other surface of the web and wherein said other surface of the web is adjacent the grooved roll during the creping step.

5. A nonwoven web made according to the method of claim 4.

6. A nonwoven web as recited in claim 5 wherein the web has a basis weight to about 125 grams per square meter.

7. A nonwoven web as recited in claim 6 wherein the web is foreshortened in the machine direction between about 40 and about 75 percent.

8. A method as recited in claim 1 further comprising the step of heating the pattern embossed web to an elevated temperature prior to the creping step.

9. A method as recited in claim 2 further comprising the step of heating the pattern embossed web to an elevated temperature prior to the creping step.

10. A method as recited in claim 1 wherein the creping step is performed against a driven grooved roll that is heated to an elevated temperature.

11. A method as recited in claim 2 wherein the creping step is performed against a driven grooved roll that is heated to an elevated temperature.

* * * * *